United States Patent [19]

Piercy

[11] Patent Number: 4,537,434

[45] Date of Patent: Aug. 27, 1985

[54] ADJUSTABLE SELF-RELEASING HOOK

[75] Inventor: William B. Piercy, Alameda, Calif.

[73] Assignee: The United States of America as represented by the Secretary of the Navy, Washington, D.C.

[21] Appl. No.: 606,011

[22] Filed: May 2, 1984

[51] Int. Cl.[3] ..... B66C 1/38

[52] U.S. Cl. ..... 294/82.31; 294/82.36

[58] Field of Search ..... 294/66 R, 75, 83 R, 294/83 A, 84; 24/232 R, 241 P, 241 PS

[56] References Cited

U.S. PATENT DOCUMENTS

| | | | |
|---|---|---|---|
| 703,713 | 7/1902 | Smith et al. | 294/83 R X |
| 1,477,836 | 12/1923 | McGowan | 294/83 R |
| 1,541,991 | 6/1925 | Moody et al. | 24/241 PS |
| 1,622,971 | 3/1927 | Porter | 24/241 P |
| 3,109,676 | 11/1963 | Mercer | 294/84 |
| 3,218,100 | 11/1965 | Bendl | 294/83 R |
| 4,379,579 | 4/1983 | Mahan et al. | 294/83 R |

*Primary Examiner*—Johnny D. Cherry

*Attorney, Agent, or Firm*—Robert F. Beers; Joseph M. St.Amand

[57] ABSTRACT

A load lowering hook is equipped with a spring biased load holding member which ejects and disengages the load rigging when the load touches down and the majority of the weight is released. The spring loaded member can be adjusted to disengage the load at a preset weight depending upon the weight of the rigging that will still be pulling on the hook after the load touches down.

10 Claims, 3 Drawing Figures

ADJUSTABLE SELF-RELEASING HOOK

BACKGROUND OF THE INVENTION

This invention relates to automatic hook releasing assemblies and more particularly to a self-releasing hook which is adjustable in the setting of its release load and which makes allowances for the use of variable rigging hardware and the resultant variable loads at which it is desired that the hook self release.

Prior devices used to lower and release loads on the ocean floor have proved to be often unreliable. The device most often used to remotely release a load in the ocean environment has been the acoustic release; this device requires modifications and special procedures when used for heavy loads in excess of 10,000 pounds, and is often unreliable. Other methods of releasing loads on the ocean floor require either divers or deep submergence vehicles to manually activate the release mechanism. Such operations require a considerable amount of time and effort and frequently are hazardous. In general, the prior self-releasing hooks have been found to be unsatisfactory due to unreliable, unsafe or complex mechanisms. The present invention is a safer, simpler, and more reliable method to lower and release loads in the ocean when motion compensation is used. This invention also has uses in dockside operations with similar advantages.

It is an object of the invention, therefore, to provide a simple, reliable device for automatically releasing a load that is set in place on the ocean floor.

Another object of the invention is to provide a self-releasing load hook assembly that is adjustable in the setting of the release load.

SUMMARY OF THE INVENTION

The adjustable self-releasing hook consists of a pivoting hook designed to automatically release a load and its rigging hardware once the load is set in place. Variations in rigging hardware and the consequential variations in rigging hardware weights are accommodated by an adjustable tension spring. A safety lock pin is incorporated to prevent accidental release, and the hook is designed to reduce the risk of fouling on cables, wires, etc., once the load is released.

DESCRIPTION OF THE PREFERRED EMBODIMENT

Figure 1:
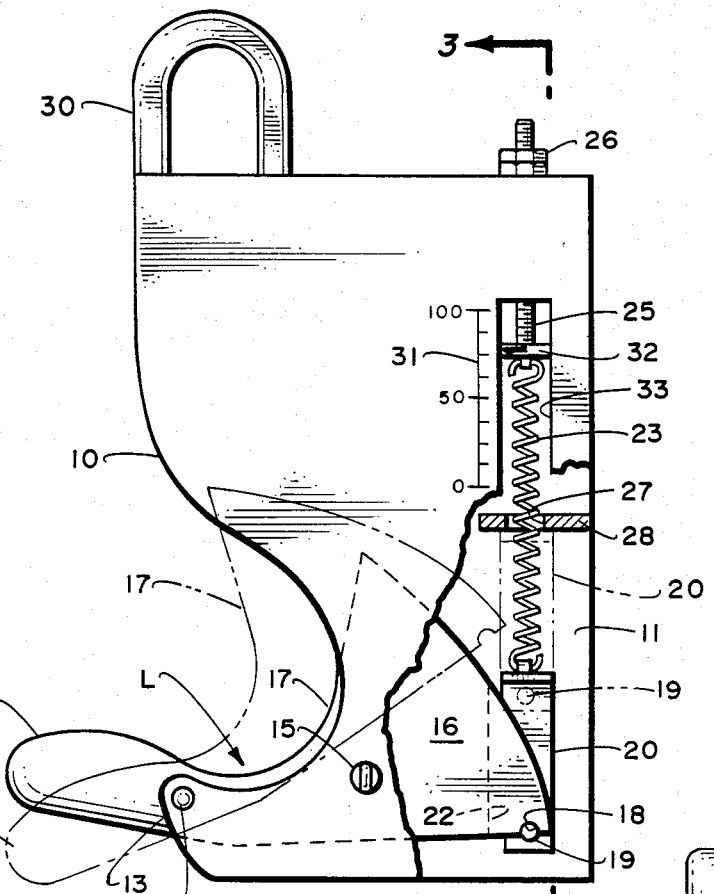
FIG. 1 is a side view, partially cut-away, showing an embodiment of the adjustable self-releasing hook assembly.
Figure 2:
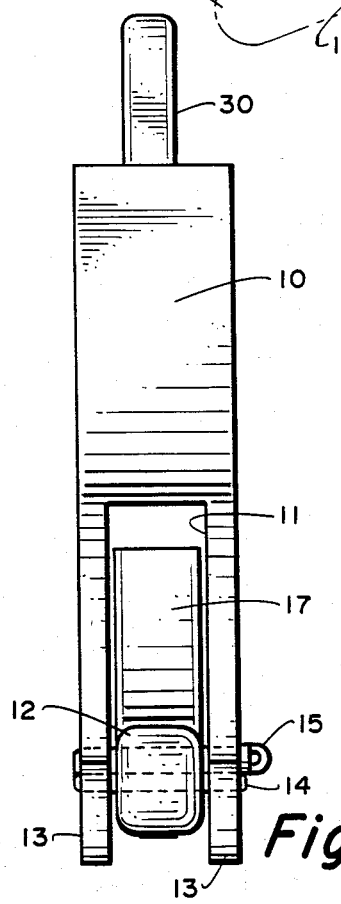
FIG. 2 is a front view of the adjustable self-releasing hook assembly shown in FIG. 1.
Figure 3:
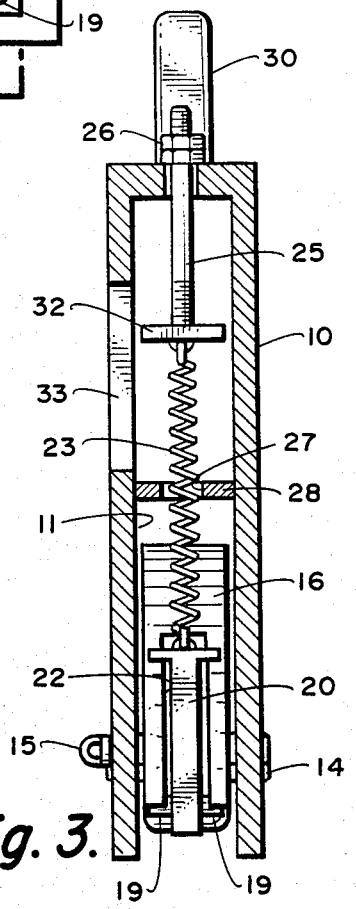
FIG. 3 is a cross-sectional view of the adjustable self-releasing hook assembly taken along line 3—3 of FIG. 1.

The adjustable self-releasing hook assembly consists of a main body structure 10 having a hook-shaped cavity portion 11 in the lower half in which a pivotable releasing hook 12 is mounted as shown in FIGS. 1, 2 and 3. The hook-shaped cavity portion 11 consists of parallel side walls each having a nose section 13 and a crotch section rearward of the nose section of substantially the same configuration as the crotch portion of hook 12. Hook 12 is mounted within the hook-shaped cavity portion 11 by means of a pivot pin 14 located at the hook nose section 13 of main body structure 10. A locking pin 15 which passes through the rear body portion 16 of hook 12 and respective holes on each side of cavity portion 11 of the main body structure serves to secure releasing hook 12 in the load holding position until such time that all rigging is complete and a load is ready to be hoisted and/or lowered.

The front side 17 of the rearward body portion 16 of hook 12 has a sloping shape to assist in ejecting rigging hardware or a cargo sling at the time the hook releases a load. The lower end of rear body portion 16 of hook 12 includes catch slots 18 which engage with a catch bar 19 on catch mechanism 20 that fits within a slot 22 in the rear body portion 16 when the assembly is in a load holding position, as shown in FIG. 3. Catch mechanism 20 is attached at its upper end to one end of a tension spring 23. The other end of tension spring 23 is connected to a tension adjusting screw 25 which is adjusted via lock nuts 26. The general shape of the rearward body portion 16 of hook 12 operates to prevent entanglement of lines in the hook mouth when released.

The weight of the body portion 16 of hook 12 will operate to cause it to fall back against catch bar 19 once a load is set in place and the load rigging or cargo sling is ejected; this permits the hook assembly to readily be reset to a load holding position.

Tension spring 23 passes through an aperture 27 in a stop plate 28 which serves to hold catch mechanism 20 in place (in a raised position) so that catch slots 18 at the rear of hook 12 will engage catch bar 19. When load rigging is placed on the assembly hook, the rigging weight forces hook 12 to the position as shown in FIGS. 1 and 3 where it can be locked in that load holding position until ready to move another load. The adjustable self-releasing hook assembly can be rigged to a lifting cable by means of an eye 30 attached to the top side of main body 10 or by any other suitable means.

A scale 31 can be included on the side of main body 10, as shown in FIG. 1, and a pointer 32 can be mounted on the lower end of the tension adjusting screw 25 to measure the degree of tension load. Pointer 32 can be viewed through an aperture 33, for example.

In operation, the releasing hook 12 is set in position, as shown in FIG. 1, with catch bar 19 engaged in slots 18 and tension spring 23 adjusted to preset the ejection force to the weight of the residual rigging on the hook. Locking pin 15 is in position, securing hook 12 from pivoting. The load and rigging hardware, not shown, are then hung in a standard fashion on the self-releasing hook assembly with the weight concentrated in the crotch area at approximately point L (see FIG. 1). Once the load is made ready to be hoisted and lowered, and set in place, the locking pin 15 is removed. The adjustable self-releasing hook is now ready to operate; the load can now be hoisted and lowered until set in place on the ocean floor. As the load is lifted the crotch of hook 12 will be depressed slightly downward until it is at the same level as the crotch of the hook shaped portion of main body structure 10. The weight of the load is borne by the hook assembly in the area of point L, rearward of pivot 14. At the moment the main load touches the seafloor (or ground), the hook assembly is subjected to a large drop in load and is then only carrying the weight of the rigging hardware. Since spring 23 has been adjusted to be greater than the weight of the rigging hardware, the lift of tension spring 23 is sufficient to cause catch bar 19 to raise the rearward end of hook 12 to self release and eject the rigging hardware from the hook and consequently release the load.

The main advantage of this invention over previous methods is simplicity of operation and reliability. Included among its features are a tension adjust mechanism, locking means, and a release hook shaped to prevent entanglement of wires, cables and lines, when the hook is released. As the hook assembly opens, the shaped rearward portion 16 of the release hook 12 within the main body cavity 11 pivots up as the forward nose end of the hook pivots down, while physically preventing any wires, etc., from becoming entangled inside the hook mouth.

The adjustable self-releasing hook assembly can be modified in many ways to meet varying requirements. A variety of sizes can be made for different loads. Different materials can be used for various environments and applications, e.g., stainless steel for seawater environments, and changes in mechanical configurations can be arranged to meet the desired shape of the hook for various applications.

Obviously many modifications and variation of the present invention are possible in light of the above teachings. It is therefore to be understood that within the scope of the appended claims the invention may be practiced otherwise than as specifically described.

What is claimed is:

1. A load-carrying adjustable self-releasing hook assembly, comprising:

a. a main body structure having a fixed lower hook-shaped portion and a means for attaching the assembly to a lifting cable; said lower hook-shaped portion having a nose section and a crotch section;

b. a main hook member having a body portion and a nose portion defining together a hook crotch for the reception of load rigging and slings;

c. said main hook member being mounted to pivotally rotate between the nose portion and the hook crotch at a point toward the end of the nose section of said main body structure such that the nose portion of said main hook member and the nose section of said main body structure are aligned in the same direction with the crotch section of the main body structure and the hook crotch of the main hook member being substantially in alignment rearward of the main hook member pivot point when the adjustable self-releasing hook assembly is in a load holding position;

d. means for securely locking said main hook member in the load holding position in alignment with the hook-shaped portion of said main body structure while a load is readied to be moved; said main hook member operable to be unlocked prior to moving a load to allow the main hook member to be pivoted when relieved of load weight;

e. an eject mechanism means mounted within said main body structure;

f. the body portion of said main hook member engaging said eject mechanism means when the body portion is pivoted toward the load holding position that places the hook crotch in substantial alignment with the crotch section of the main body structure;

g. said eject mechanism means being operable to be adjusted to compensate for various load rigging weights to provide a force sufficient to eject the load rigging from the hook assembly when a load is lowered into place and only the weight of the load rigging remains carried by the hook assembly; said eject mechanism means operating to cause the body portion of said main hook member to pivot upward carrying the weight of residual load rigging while lowering the nose portion thereof thereby ejecting the load rigging; and h. said main hook member being shaped to prevent entanglement of cables and lines when the main hook member releases and ejects the load rigging.

2. A load-carrying adjustable self-releasing hook assembly as in claim 1, wherein said main hook member is pivotally mounted within a cavity in the lower portion of said main body structure.

3. A load-carrying adjustable self-releasing hook assembly as in claim 1, wherein the lower portion of said main body structure comprises two downward depending hook-shaped side walls, and said main hook member is pivotally mounted between said hook-shaped side walls.

4. A load-carrying adjustable self-releasing hook assembly as in claim 1, wherein the shape and weight of the body portion of said main hook member being such that once the load rigging is ejected it operates to fall back to re-engage said eject mechanism means, allowing the hook assembly to be reset to a load holding position.

5. A load-carrying adjustable self-releasing hook assembly as in claim 1, wherein said eject mechanism means includes an adjustable tension spring for increasing or decreasing the force required to eject the load rigging.

6. A load-carrying adjustable self-releasing hook assembly as in claim 1, wherein said eject mechanism means includes indicator means within said main body structure for measuring and setting the desired ejection force.

7. A load-carrying adjustable self-releasing hook assembly as in claim 1, wherein said body portion of said main hook member includes a slot and grooves in the rearward portion thereof which engages with said eject mechanism means.

8. A load-carrying adjustable self-releasing hook assembly as in claim 1, wherein said eject mechanism means comprises a catch bar means connected to one end of an adjustable spring means; said catch bar means operating to engage the body portion of said main hook member; and, a stop plate which operates to hold said catch bar means in place to re-engage with said body portion of said main hook member following ejection of load rigging and when resetting the hook assembly to a load holding position.

9. A load-carrying adjustable self-releasing hook assembly as in claim 8, wherein said adjustable spring means is placed in tension when the hook assembly is reset and the main hook member is locked in a load holding position.

10. A load-carrying adjustable self-releasing hook assembly as in claim 8, wherein said catch bar means fits within a rearward slot in the body portion of said main hook member; said catch bar means operating to engage grooves on either side of said rearward slot.

* * * * *